United States Patent [19]

Weibel et al.

[11] 4,402,497

[45] Sep. 6, 1983

[54] APPARATUS FOR UNSTACKING A PILE OF SHEETS

[75] Inventors: Kurt Weibel, Pfyn; Walter Würsch, Frauenfeld, both of Switzerland

[73] Assignee: WUFAG AG, Oberurnen, Switzerland

[21] Appl. No.: 308,846

[22] Filed: Oct. 5, 1981

[30] Foreign Application Priority Data

Oct. 7, 1980 [CH] Switzerland ..... 7477/80

[51] Int. Cl.[3] ..... B65H 5/08

[52] U.S. Cl. ..... 271/11; 271/30 A; 271/100; 271/107; 271/243; 271/272

[58] Field of Search ..... 271/5, 11, 107, 30 A, 271/243, 244, 272, 273, 274, 100

[56] References Cited

U.S. PATENT DOCUMENTS 1,428,149 9/1922 De Minico .
2,262,798 11/1941 Elliott ..... 271/100 X
3,810,612 5/1974 McCahon ..... 271/11
3,973,767 8/1976 Kramer ..... 271/100 X

*Primary Examiner*—Richard A. Schacher
*Attorney, Agent, or Firm*—Karl F. Ross

[57] ABSTRACT

An unstacking apparatus comprises one or more sheet-entraining drums each having a peripheral depression, lying behind a rising forward edge, onto which the first sheet of a confronting stack is pulled by suction cups during every drum revolution. A counterpressure roller osscillatable about the drum axis is then swung from a position downstream of the depression past its forward edge, against the sense of rotation of the drum, to engage the pulled-off sheet and deliver it to a conveyor. Each counterpressure roller is spring biased toward the associated drum but is prevented by a stop from reaching the bottom of the depression in the absence of an entrained sheet. A sensor on the drum shaft or on the roller shaft emits an alarm signal whenever the distance between these shafts deviates from a predetermined range limit.

10 Claims, 8 Drawing Figures

APPARATUS FOR UNSTACKING A PILE OF SHEETS

FIELD OF THE INVENTION

Our present invention relates to an apparatus for unstacking a pile of sheets, the latter term including both individual layers of flexible material and folded foils such as signatures, quires or gatherings.

BACKGROUND OF THE INVENTION

Conventional unstackers, e.g. as described in U.S. Pat. No. 1,428,149, comprise an entrainment roller and a counterpressure roller whose parallel shafts are movable toward and away from each other; the entrainment roller has a peripheral recess terminating at its trailing end in a hook which engages an edge of a sheet deposited in that recess with the aid of pick-up means such as levers or bars carrying suction cups. As the sheet moves into the nip of the counterrotating rollers, it is bent around the hook and is then positively entrained to a release point for delivery to a conveyor or other receiving equipment.

Devices of this character are not suitable for use with sensitive sheet material which may be damaged by the bending. Moreover, the recess with its hook must be adapted to the sheet thickness so that different entrainment rollers are required for different thicknesses.

OBJECT OF THE INVENTION

The object of our present invention, therefore, is to provide an improved unstacking apparatus for the purpose set forth which is of simple construction, accommodates a wide range of sheet thicknesses and allows the handling of delicate foils.

SUMMARY OF THE INVENTION

An apparatus according to our invention comprises an entrainment roller—referred to hereinafter as a drum—rotatable on a first shaft and coacting with a counterpressure roller on a second shaft parallel thereto, the drum having a generally circular peripheral outline with a depression which is bounded by a forward edge farther from the axis of rotation. A pile of sheets to be unstacked is advanced by stationary guide means toward the drum in a generally radial direction, a sheet proximal to the drum being detached from the pile by pick-up means synchronized with the rotation of the drum whereby a marginal portion of the detached sheet is introduced into the depression of the drum periphery. The second shaft is movable relatively to the first shaft in both the radial and the peripheral direction of the drum with the aid of operating means so synchronized with the pick-up means that the counterpressure roller is displaced in the direction of rotation out of line with the pile prior to the detachment of the sheet by the pick-up means and is thereupon displaced in the opposite peripheral direction past the forward edge of the depression into a position overlying the marginal sheet portion, the second shaft being provided with biasing means urging the counterpressure roller toward the sheet portion overlain thereby. In its continuing rotation, the drum then entrains the sheet between itself and the counterpressure roller (which need not be separately driven) toward its destination.

Advantageously, the two shafts are horizontal and the guide means comprises a sloping shelf which approaches a descending side of the drum near a horizontal midplane thereof, so that the sheet detached from the pile tends to follow under its own weight the movement of the drum periphery upon being released from the grip of the pick-up means which may comprise suction cups as known per se.

Unless the drum and the counterpressure roller are of very large axial width, it will usually be necessary to provide two or more drums and two or more counterpressure rollers on the respective shafts. In any event, the second shaft may be slidably mounted on a plurality of supporting arms which are fulcrumed on the first shaft, these arms carrying springs which constitute the aforementioned biasing means. We further prefer to provide these supporting arms with stops limiting the displacement of the second shaft toward the first shaft to a minimum distance at which the counterpressure roller or rollers are radially spaced from the lowest point of the depressions of the associated drums, particularly when these depressions also have rear edges which are farther than these lowest points from the drum axis. This avoids an excessive increase in the compressive force acting upon the entrained sheet when that rear edge passes the counterpressure roller.

The depression of the drum periphery may have various shapes as more fully described hereinafter. Thus, for example, its forward edge may be part of a radial shoulder rising from a leading end thereof to a point lying either on or beyond the circular outline of the drum whose radius is constant over the major part of its periphery.

In accordance with another feature of our invention, we provide sensing means preferably of the contactless type on one of the two shafts for detecting an abnormal deviation of the distance between these shafts from a predetermined range.

BRIEF DESCRIPTION OF THE DRAWING

The above and other features of our invention will now be described in detail with reference to the accompanying drawing in which.

SPECIFIC DESCRIPTION

Figure 1A:
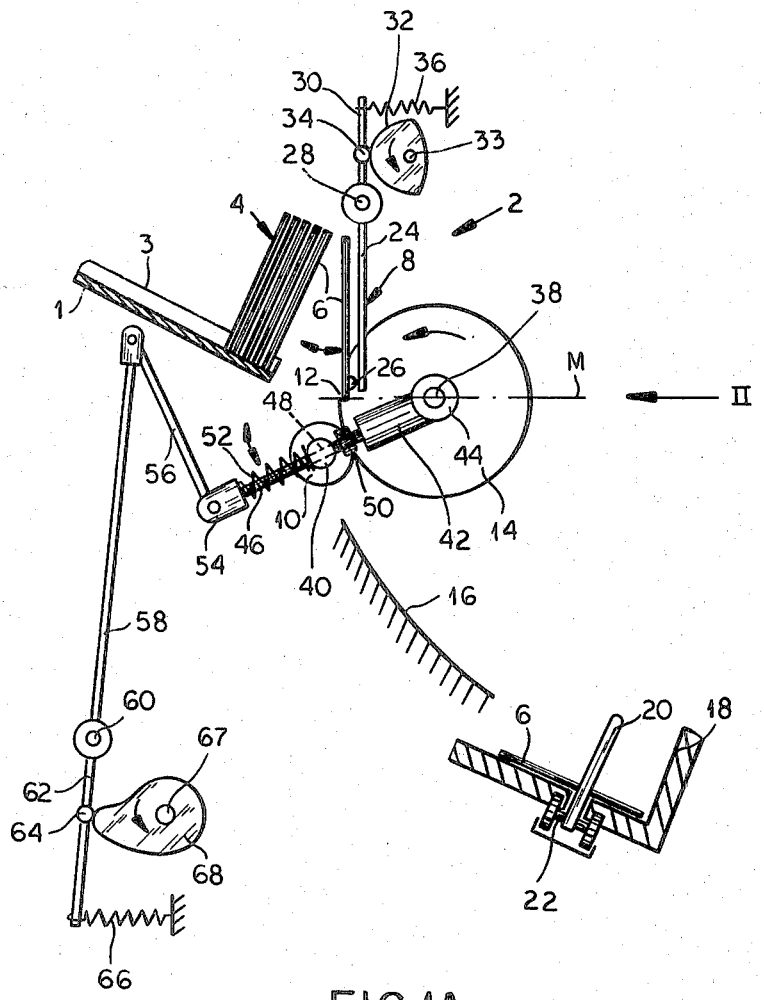
FIG. 1A is a somewhat diagrammatic side-elevational view of an unstacking apparatus embodying our invention.
Figure 2:
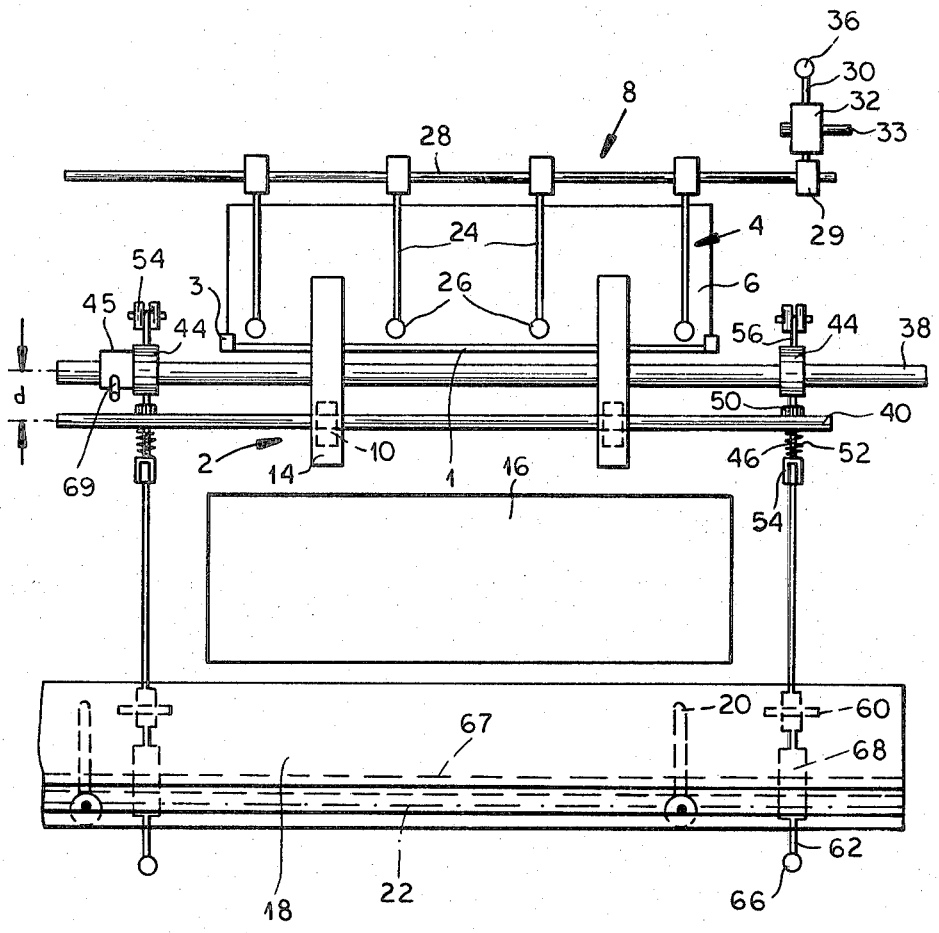
FIG. 2 is a front-elevational view of the apparatus as seen in the direction of an arrow II in FIG. 1A.

In FIGS. 1A and 2 we have shown a sloping shelf 1 with lateral guide flanges 3 on which a stack 4 of sheets 6 (e.g. signatures) is slidable toward an unstacker 2 according to our invention. The unstacker comprises a pick-up device 8 with several arms 24 which depend from a horizontal shaft 28 and are provided at their free lower ends with suction cups 26 connected to a source of vacuum via nonillustrated conduits. A hub 29 on shaft 28 carries a rod 30 provided with a cam follower 34 which is held by a spring 36 against a rotary cam 32 on another shaft 33. Two further horizontal shafts 38 and 40 respectively carry a pair of axially separated drums 14, which are interleaved with the arms 24, and a pair of counterpressure rollers 10 coacting with these drums.

Shaft 40 has two transverse bores 48 penetrated by respective bolts 46 which are threaded at one end into respective blocks 42 that are freely swingable about shaft 38. At their opposite ends the bolts 46 terminate in respective forks 54 that are articulated to links 56 which in turn are hingedly connected with a pair of lever arms 58 with stationary fulcra 60. Lever arms 62 rigid with arms 58 carry cam followers 64 which are urged by respective springs 66 onto associated rotary cams 68 mounted on a horizontal shaft 67. Shafts 28, 38 and 67 are journaled in fixed bearings which have not been illustrated.

Figure 3:
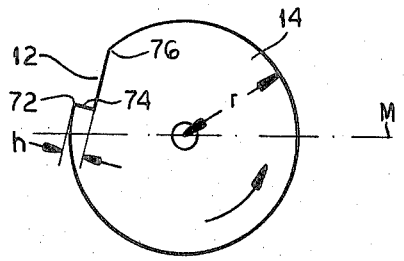
FIGS. 3–5 are end views of different drums usable with the apparatus shown in the preceding Figures.

The bolts 46 are surrounded by coil springs 52 which bear upon respective extremities of shaft 40 for biasing same toward the drum shaft 38. The sliding motion of shaft 40 on the bolts 46 is limited by a pair of stop nuts 50 threaded onto these bolts. The position of nuts 50 is so chosen that rollers 10 are pressed by the springs 52 onto the periphery of the associated drums 14 in all angular positions of the latter except when these rollers are confronted by a peripheral depression 12 more clearly illustrated in FIG. 3. Depression 12 is bounded at its front (as viewed in the direction of drum rotation) by a radial shoulder 74 of height h which exceeds the thickness of sheets 6. Depression 12 is a recess of triangular profile with a rear edge 76 spaced from the drum axis by the same distance as an elevated edge or ridge 72 of shoulder 74, namely by the radius r of the drum surface which is circularly cylindrical over the major part of its periphery.

A fixed guide 16 is positioned underneath the drums 14 for directing sheets 6 removed from stack 4 into an open trough 18 along which the sheets are individually entrained by upstanding flights 20 of an endless conveyor 22.

As further shown in FIG. 2, one of the blocks 42 connected with bolts 46 has a hub 45 carrying a proximity sensor 69 of conventional contactless type pointing toward shaft 40. Sensor 69 emits an alarm signal when, for any reason, the distance d separating the shafts 38 and 40 exceeds a predetermined limit so that the rollers 10 no longer contact the cylindrical portion of the drum periphery. In certain instances, as when there are no stop nuts 50 and when there is a risk that the drums and the rollers may become accidentally disaligned, such a sensor may also signal an abnormally close approach of the shafts toward each other.

Figure 1B:
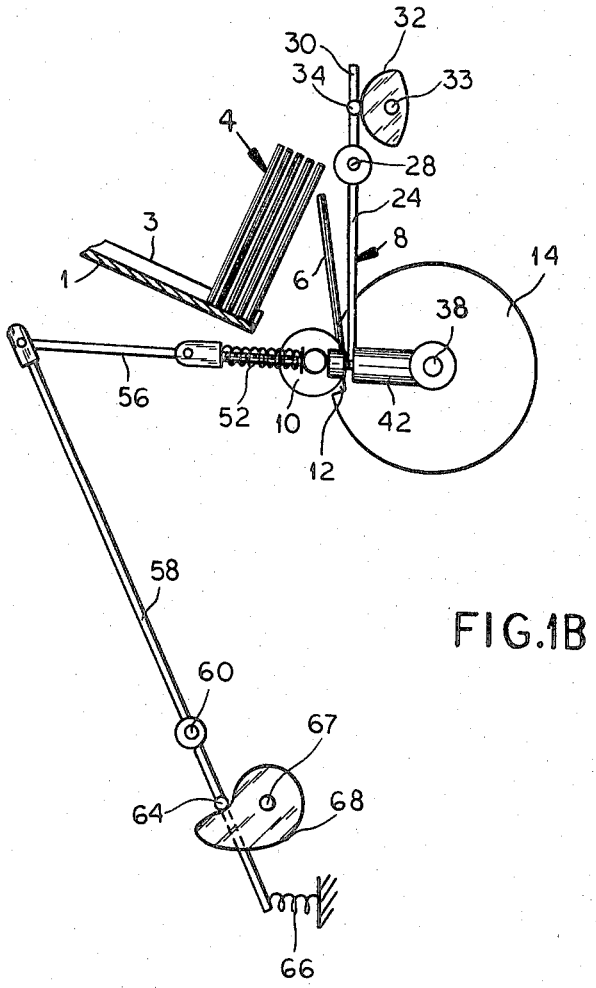
FIGS. 1B, 1C and 1D are diagrammatic side-elevational views of part of the apparatus of FIG. 1A in different operating positions.

In operation, drums 14 and cams 32, 68 are continuously rotated counterclockwise (as indicated by arrows in FIGS. 1A and 3) in mutual synchronism by nonillustrated drive means coupled with shafts 33, 38 and 69. In the position of FIG. 1A a high dwell of each cam 68 has swung the associated lever 58, 62 clockwise about its pivot 60 to impart a counterclockwise swing to the bolts 46 carrying the shaft 40 whereby the rollers 10 idling on that shaft are moved below a horizontal midplane M passing through the drum axis. Earlier the pick-up arms 24 were swung out by a low dwell of cam 32 toward the stack 4( as illustrated in FIG. 1D) whereby, owing to the concurrent application of vacuum to suction cups 26, the nearest sheet 6 is gripped and removed from the stack after the descent of the rollers as the arms 24 are swung back by a high dwell of cam 32. At this very instant, as shown in FIG. 1A, the depressions 12 of drums 14 approach the midplane M whereby a lower marginal portion of the gripped sheet is pulled into these depressions so as to come to rest against their bottoms. Immediately thereafter, as seen in FIG. 1B, a low dwell of each cam 68 lets the associated levers 58, 62 be pivoted counterclockwise by their springs 66 whereby links 56 pull the bolts 46 into a substantially horizontal position. The rollers 10, having cleared the shoulders 74 of the peripheral drum depressions 12, now penetrate into these depressions to an extent determined by the nuts 50 which preferably is only a fraction of height h and ought to be so chosen that the engaged sheet 6 is only moderately compressed between these rollers and the rear edges 76 (FIG. 3) as the drums and the rollers coact to entrain the sheet upon a cutoff of the vacuum applied to suction cups 26. When sheets of a particularly delicate nature are to be handled, that rear edge may be replaced by a smooth curvilinear transition.

Figure 1C:
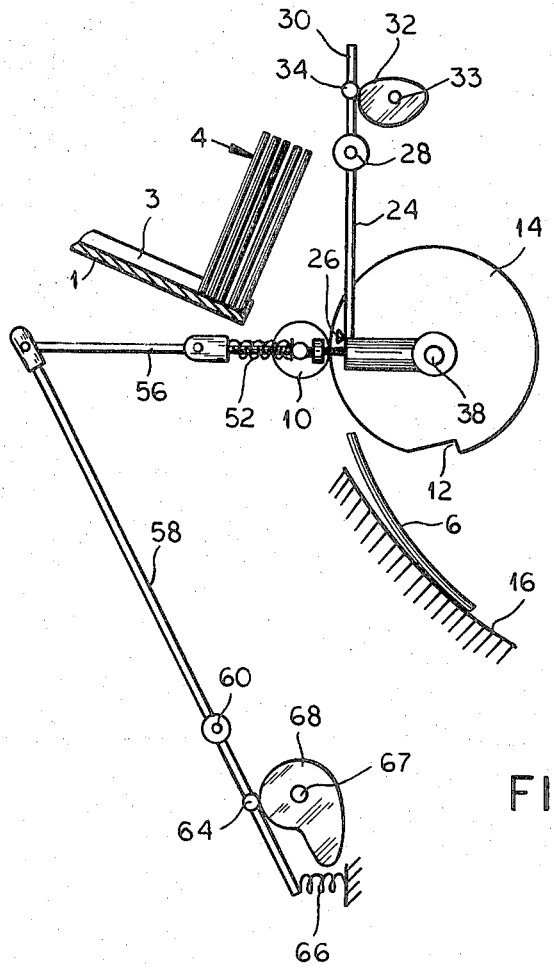
Figure 1D:
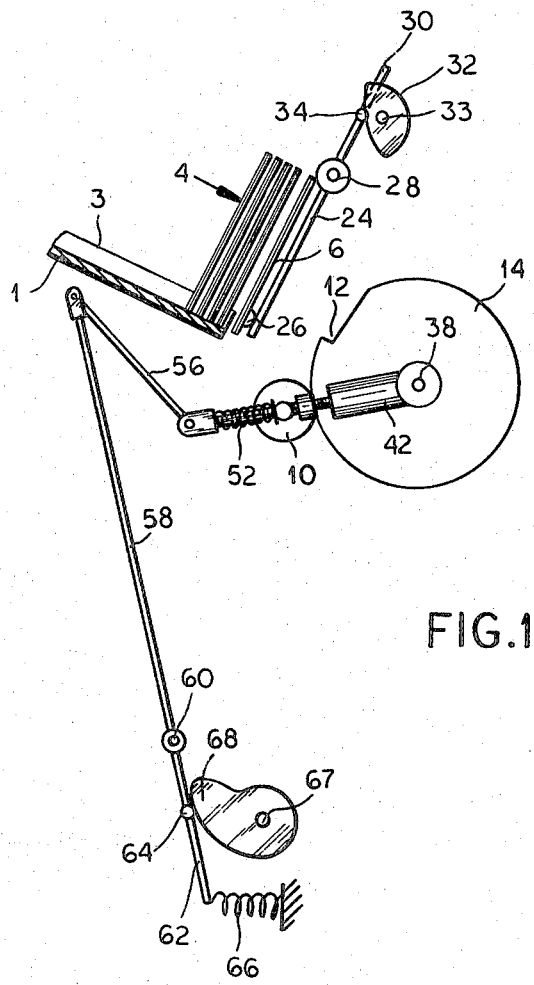

FIG. 1C shows how, with continuing counterclockwise rotation of the drums 14, the engaged sheet 6 is dislodged and dropped onto the guide 16 for delivery to the trough 18 of FIGS. 1A and 2.

After approximately another one-half turn of the drums and the cams, the aforedescribed position of FIG. 1D is reached in which a new sheet 6 is gripped by the pick-up device 8 preparatorily to its entrainment by the drums 14 and the counterrollers 10 as discussed above.

Figure 4:
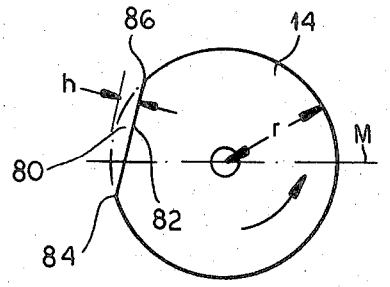

In FIG. 4 we have illustrated at 80 a possible modification of the depression of drum 14 which in this instance is constituted by a flattened zone 82 extending along a chord of the circular outline of the drum periphery. The depression 80 is here bounded by a front edge 84 and a rear edge 86 whose distance from the drum axis again equals the cylinder radius r; the lowest point of the depression has the distance $r-h$.

Figure 5:
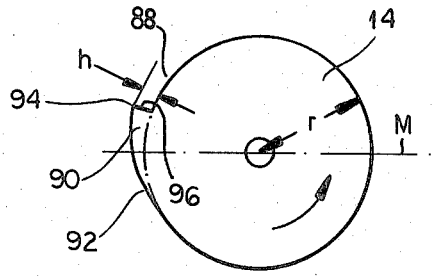

Another modified depression 88, shown in FIG. 5, is bounded at its forward edge by a radial shoulder 96 of height h formed by a projecting part 90 of the drum periphery, this part merging tangentially at 92 into the cylindrical drum surface. The ridge 94 of shoulder 96 is spaced from the drum axis by a distance $r+h$ while the bottom of the depression 88 has the cylindrical curvature of the major portion of the drum surface. The aforedescribed mode of operation is essentially the same in all three instances.

We claim:

1. An apparatus for unstacking a pile of sheets, comprising:

a drum on a first shaft rotatable about an axis, said drum having a generally circular peripheral outline with a depression bounded by a forward edge farther from said axis;

stationary guide means for advancing a pile of sheets to be unstacked in a generally radial direction toward said drum;

pick-up means synchronized with the rotation of said drum for detaching a sheet proximal to said drum from said pile and introducing a marginal portion of the detached sheet into said depression;

a counterpressure roller confronting said drum on a second shaft parallel to said first shaft, said second shaft being movable relatively to said first shaft in both the radial and the peripheral direction of said drum; and operating means synchronized with said pick-up means and coupled with said second shaft for peripherally displacing said roller in the direction of rotation out of line with said pile prior to the detachment of a sheet by said pick-up means and thereupon displacing said roller in the opposite peripheral direction past said forward edge into a position overlying said marginal portion, said second shaft being provided with biasing means urging said roller toward the sheet portion overlain thereby.

2. An apparatus as defined in claim 1 wherein said second shaft is slidably mounted on a plurality of supporting arms fulcrumed on said first shaft, said biasing means comprising springs carried on said supporting arms.

3. An apparatus as defined in claim 2 wherein said supporting arms are provided with stops limiting the displacement of said second shaft toward said first shaft to a minimum distance at which said roller is radially spaced from the lowest point of said depression.

4. An apparatus as defined in claim 3 wherein said supporting arms have threaded portions traversing said second shaft, said stops being nuts engaging said threaded portions.

5. An apparatus as defined in claim 2, 3 or 4 wherein said operating means comprises a cam-controlled linkage articulated to free ends of said supporting arms.

6. An apparatus as defined in claim 2, 3 or 4 wherein said pick-up means comprises a plurality of cam-operated bars carrying suction cups, said bars being axially offset from said supporting arms.

7. An apparatus as defined in claim 1, 2 or 3 wherein said forward edge is part of a radial shoulder rising from a leading end of said depression.

8. An apparatus as defined in claim 1, 2 or 3 wherein said depression is a flattened zone of the drum periphery extending along a chord of said circular outline.

9. An apparatus as defined in claim 1, 2 or 3 wherein said shafts are horizontal, said guide means comprising a sloping shelf approaching a descending side of said drum near a horizontal midplane thereof.

10. An apparatus as defined in claim 1, 2 or 3, further comprising sensing means on one of said shafts for determining the proximity of the other of said shafts and emitting an alarm signal upon the separation of said shafts deviating from a predetermined range.

* * * * *